United States Patent [19]

Tamaro

[11] 4,056,154

[45] Nov. 1, 1977

[54] SQUARING OFF AND REAMING TOOL FOR DEEP ELONGATED TRENCH EXCAVATIONS

[75] Inventor: George John Tamaro, Leonia, N.J.

[73] Assignee: Icos Corporation of America, New York, N.Y.

[21] Appl. No.: 701,761

[22] Filed: July 2, 1976

Related U.S. Application Data

[62] Division of Ser. No. 603,982, Aug. 12, 1975, Pat. No. 4,005,582.

[51] Int. Cl.[2] ..... E02D 17/148

[52] U.S. Cl. ..... 175/416; 175/411; 37/DIG. 6

[58] Field of Search ..... 175/409, 411, 416, 308; 299/37, 94, 69; 61/63, 40, 81, 82, 60-63; 37/80 R, 103, DIG. 6

[56] References Cited

U.S. PATENT DOCUMENTS

| | | | |
|---|---|---|---|
| 22,151 | 11/1858 | Butler | 175/416 X |
| 101,793 | 4/1870 | Ward | 299/69 |
| 693,235 | 2/1902 | Clark | 61/60 |
| 867,536 | 10/1907 | Rochford et al. | 175/308 X |
| 3,463,549 | 8/1969 | Goodman | 299/37 |

*Primary Examiner*—Ernest R. Purser
*Attorney, Agent, or Firm*—Jim Zegeer

[57] ABSTRACT

There is disclosed a tool for squaring off and reaming the walls of an elongated trench excavation which has been previously formed utilizing the slurry trench excavation method. The tool is constituted by a pair of spaced parallel steel beams which are connected and maintained in their space relation by a plurality of connecting steel lattice bars. The lower edges of the beams and the lower connecting lattice bars have cutting and smoothing edges formed thereon for smoothing and squaring the walls of the elongated excavation. The tool may be left in the last excavation of a series and serve as the connected H-beam pair as disclosed in the article appearing in the October, 1973 issue of Roads and Streets Magazine entitled "Slurry Wall, Special Equipment Solved 'No Room' Excavation Problem".

1 Claim, 3 Drawing Figures

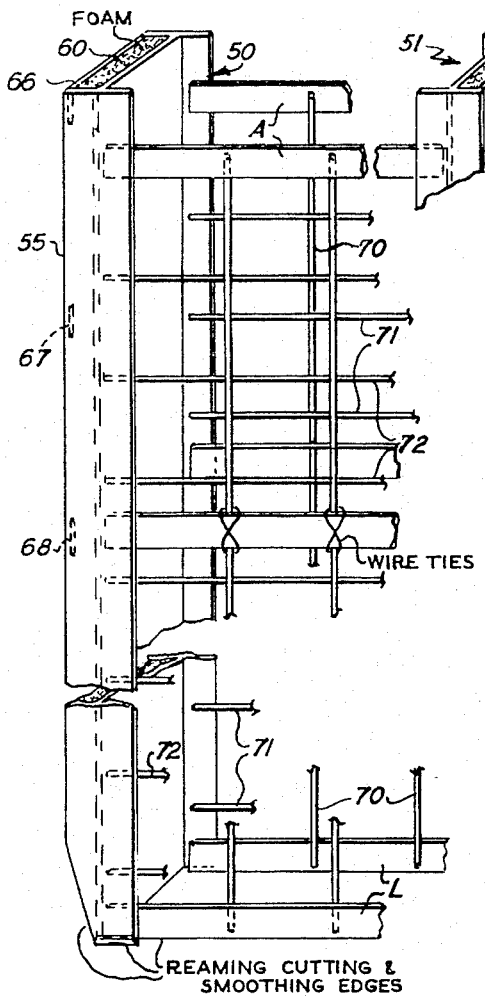
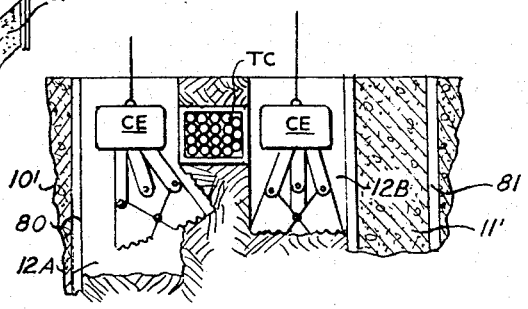
Fig. 3
Fig. 3
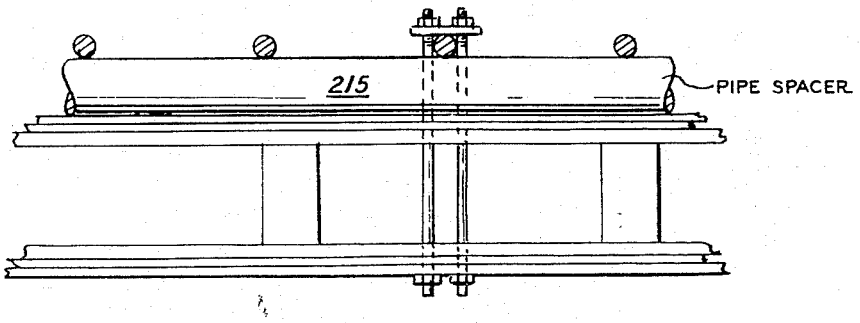
Fig. 6

SQUARING OFF AND REAMING TOOL FOR DEEP ELONGATED TRENCH EXCAVATIONS

This is a division of application Ser. No. 603,982, filed Aug. 12, 1975, and now U.S. Pat. No. 4,005,582.

The present invention relates to an improved tool for squaring off and evening the walls of an elongated trench for constructing a reinforced concrete wall in the ground utilizing a fluid substance or slurry such as bentonite, drillers mud, etc. for retaining the walls of an excavation open during the excavation. This technique has been widely used in the past and is disclosed in detail in Brunner British patent specification Nos. 913,527 and 913,528, in Veder U.S. Pat. No. 3,310,952 and Miotti U.S. Pat. No. 3,139,729 all assigned to a company related to the assignee hereof, and incorporated herein by reference. In the Miotti patent, pairs of reinforced concrete elements are set along the line of the wall and the space between the reinforced concrete elements is excavated using special tools for excavating up close to and scraping the previously cast concrete elements so as to form generally rectangular excavation elements elongated along the length of the wall. Such walls may be excavated down to great depths utilizing as guide elements the previously cast concrete elements. In accordance with the Brunner and Veder patents, a concrete curb or guide is cast along the line of the wall and a deep trench is dug as the excavation is maintained open by circulation in the excavation of a bentonite solution. Reinforcements may be then lowered into the trench and an interlocking pipe is installed in the trench at least at one end thereof. The trench is then filled with concrete from the bottom (using the tremie concreting method) forming an underground reinforced concrete wall. The interlocking pipe is removed when the concrete in the first trench has hardened or set to an extent as to be self-sustaining in its shape. This forms the key or locking element with respect to the next element. Subsequent to the depositing of the concrete, a second hole or trench is excavated in an adjacent relation to the first trench. A variation on the above-described techniques has been developed in the United States, where the first excavations are cylindrical excavations into which are placed H-beams which have a web portion transverse to the line of the trench and flange portions which are parallel generally to the line of the trench. These cylindrical excavations are then filled with a cementitious material which is just sufficient to maintain the H-beam in a vertical position. Then, between two succeeding H-beams the earth material is excavated in elongated trench sections up to and including the scraping of the not-so-hard cementitious material from the H-beam surfaces facing each other. These sections then may have steel reinforcement cages lowered thereinto and filled with concrete. The main deficiency of the method is the difficulty of maintaining verticality and therefore plan position of each beam.

THE PRESENT INVENTION

The present invention is an improvement on the reaming and squaring tool used in the fabrication of such walls. In accordance with this invention, I or H-beam pairs are welded together utilizing a light weight steel lattice work and reinforcement cage or rebar cage. This consists of two steel H-beams and the cage which are preferably prefabricated at the site and tied together with steel lattice work. The two outward channels in the H-beam are filled above ground with non-cementitious excavatable materials such as rigid block polystyrene foam to eliminate the need of end pipe joints or other time consuming and expensive procedures, such as the low strength cementitious material used heretofore in effort to position the H-beam. This aspect of the invention is disclosed in an article appearing in Oct. 1973 issue of *Roads and Streets* magazine entitled "Slurry Wall, Special Equipment Solve 'No Room' Excavation Problem " which is incorporated herein by reference.

The foam system disclosed in the *Roads and Streets* article, invented by the applicant herein is deemed to be a part of the prior art insofar as the present invention is concerned.

Such H-beam pairs are lowered into the trench and in the first of said structures the primary structural framework of H-beam pairs is used as a reaming tool. For this purpose, the lower edges may be sharpened by a grinder, files or a cutting torch. This tool squares off and evens out the excavation prior to the installation of the permanent steel framework constituted by another pair of H-beams joined together by a rebar cage but of a somewhat lighter weight metal than the reaming tool. The reaming tool may be used as the concrete reinforcement and H-beam pair in the last panel section to be formed.

Insertion of the primary structural framework is facilitated by an innovative combination of double H-beams used as a reaming tool. This tool squares off and evens out the excavation prior to the installation of the permanent steel framework.

DETAILED DESCRIPTION OF THE INVENTION

As an initial step, the line of cut or of the wall to be formed, is defined by casting a pair of concrete curbs CGC as in Brunner's above-identified British patent, which serves as an initial guide means for excavation devices, which in the embodiments to be described herein are preferably clamshell excavators and, also as aids in aligning and lowering the connected H-beam pair described later herein.

Figure 1:
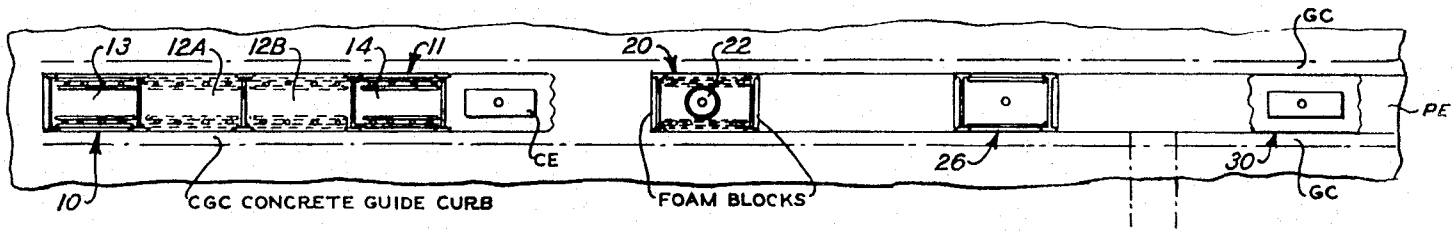
FIG. 1 is a top plan view illustrating a typical plan of excavation sequence along a line of the wall.
Figure 2:
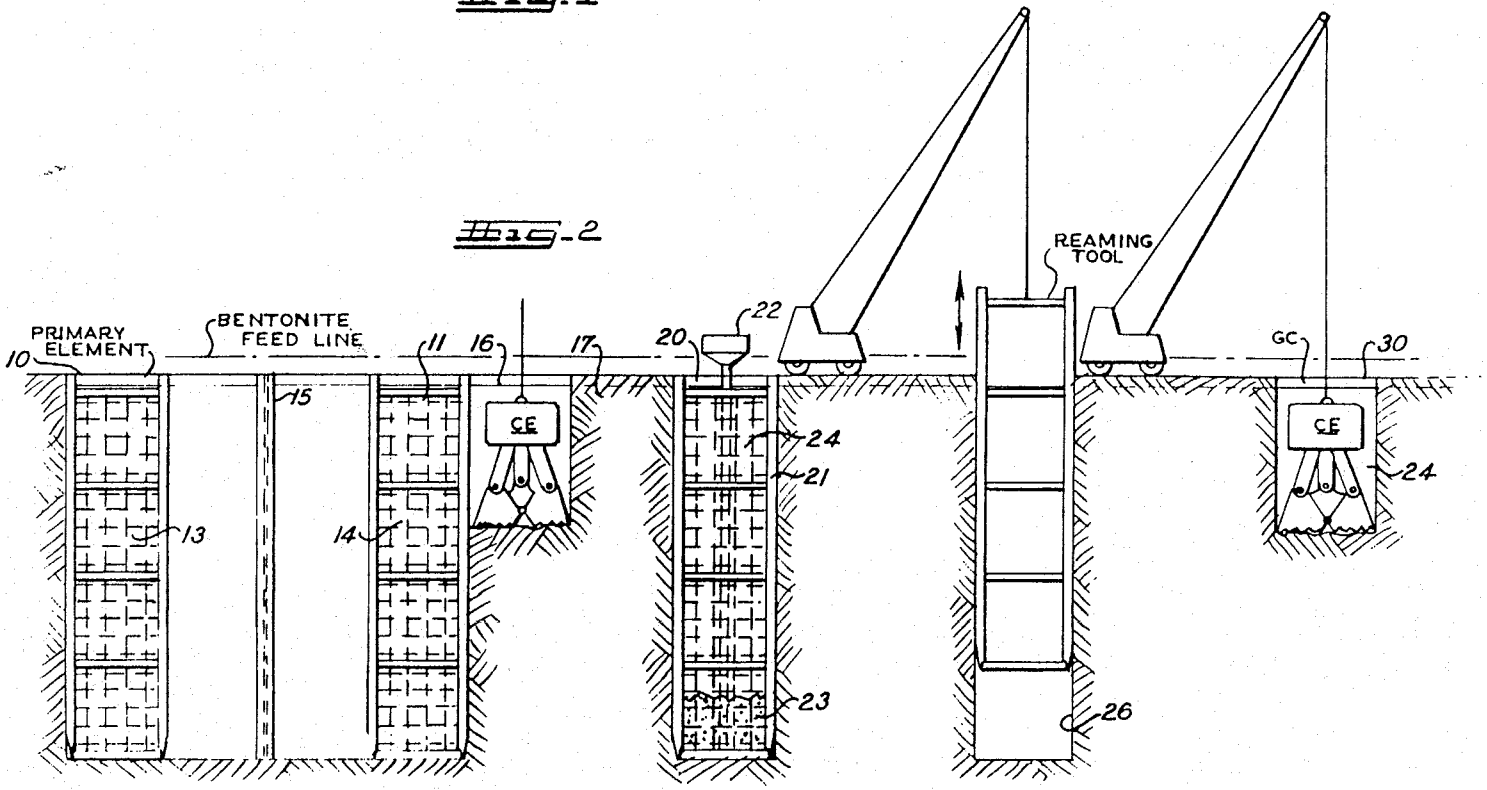
FIG. 2 is a side elevation view illustrating the different phases of the construction in a sequence.

Referring now to FIGS. 1 and 2, the first primary excavation section 10 is excavated using a clamshell excavator (CE) which has an expanse or bite of, for example, 10 feet. This first primary elongated trench section 10 is excavated down to the depth D of the wall (which can vary according to bed rock formation, etc.) and as the excavation progresses, a thixotropic colloidal liquid or slurry apt to gel, such as a thickish liquid known in the art as a bentonite slurry or driller's mud, is introduced into the excavation to maintain the walls and prevent collapse thereof during the excavation process, and a bentonite cake formed for waterproofing purposes. A bentonite pond, reservoir or tank (not shown) may be maintained for cleaning the bentonite and reusing same and supplying same via a bentonite line BSL shown diagrammatically in FIG. 2, to the individual excavations as they proceed.

In FIGS. 1 and 2, the first primary excavation 10 is shown as completed and the second excavation 11 has also been completed with connected H-beam pairs 13 and 14 inserted therein and concreted. Primary excavations 10 and 11 are spaced apart a distance greater than the open extent of the excavating tool CE. This permits the excavation of the intervening soil sections 12A and 12B by using the said H-beam channel section as a guide, the opposite side of the clamshell excavator CE being free. As shown the intervening excavation sections 12 are secondary sections and have been designated 12A and 12B, also have an intermediate H-beam 15 inserted therein. These sections are now ready for receipt of a further steel reinforcement cage, as will appear more fully hereinafter. These sections may be filled with a steel fiber reinforced concrete eliminating steel reinforcement cages.

In FIGS. 1 and 2, primary panel section 20 is shown as being in the process of being concreted. Primary panel 20 section has been excavated and reamed and an H-beam rebar pair 21 inserted therein. In addition, the concrete tremie pipe 22 is shown lowered into the excavation and in the process of depositing concrete 23 to displace the bentonite slurry 24. The bentonite slurry may be removed from the panel excavation 20 at the same rate that concrete is introduced through tremie pipe 22. As further illustrated in FIG. 2, the next primary panel section 26 has been excavated by clamshell CE and is in the process of having the side walls and ends thereof reamed by the combination double H-beams which may be strengthened by addition of extra lattice connecting bars and sharpened lower edges for use as a reaming, smoothing and squaring "tool". This reaming tool therefore squares off the ends and evens out the excavation prior to the installation of the permanent H-beam rebar pair. The crane is shown as lowering the H-beam pair which is performing the reaming operation through the action of gravity. It should be appreciated that the H-beam pair may be driven by a power implement instead of simply being raised and lowered by the crane. The debris in the bottom of the reamed excavation is easily removed by the clamshell.

Elongated trench sections are excavated in the manner illustrated to the end of the wall section where the final primary excavation 30 is made. In this instance, the clamshell excavator CE is shown in the initial stages of the excavation and the trench is filled with the slurry 24 and maintained full during the excavation process. In the case of the secondary excavations 16–17, e.g., the excavations intermediate and adjacent a primary excavation, the H-beam channel is used as the guide channel for the clamshell excavator. Foam blocks retained in these channels by temporary angle irons prevent poured concrete which may pass between the flanges of the H-beam and the earth wall from reaching the channel and its surfaces. The clamshell excavator CE in secondary wall section 16 breaks the angles and the foam which is not in the clamshell floats to the surface of the bentonite slurry and is thereafter removed and discarded. If the foam blocks are intact, they may be reused.

CONNECTED H-BEAM PAIRS

The concept of the connected H-beam pair having foamfilled outer channels was invented by the inventor herein and used in a construction project more than a year prior to the filing date hereof as is disclosed in an article entitled "Slurry Wall, Special Equipment Solve "No Room" Excavation Problem", Oct., 1973 issue of *Roads and Streets* Magazine.

Figure 3:
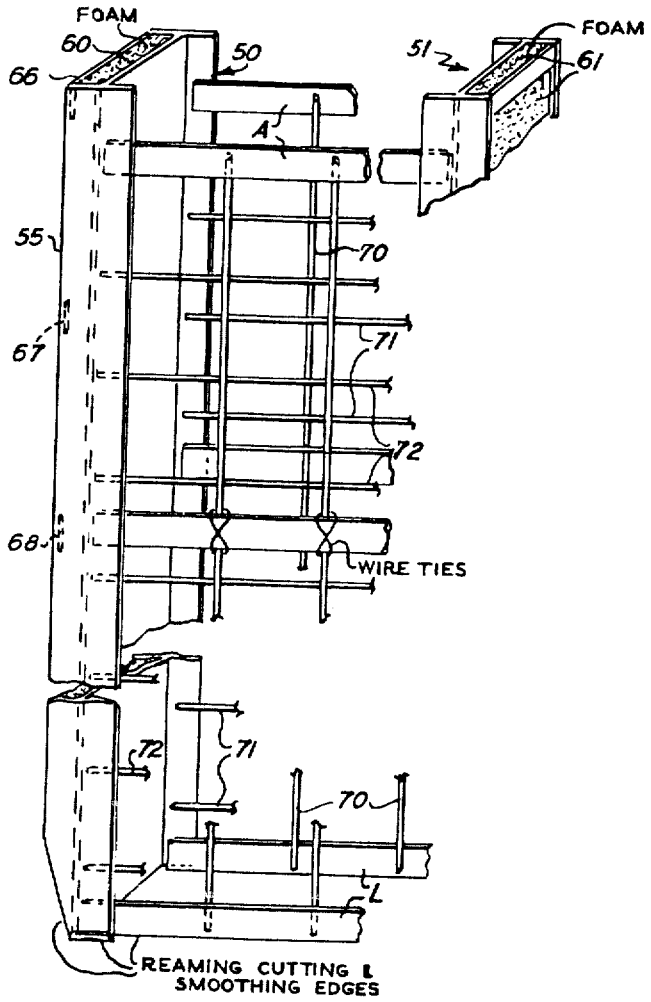
FIG. 3 is an isometric view of the H-beam pair and rebar reinforcements showing the formation of the lower edges of the H-beam pair cutting edges for use as a reaming tool.

In FIG. 3 there is shown a view of a typical connected H-beam pair having foam-filled outer channel; each H-beam pair is constituted by a pair of wide flange H-beams 50 and 51 wherein the flanges of the beams 52, 53 and 54, 55 have their connecting web portions 56, 57, respectively, transverse to the elongated direction of the wall to be formed thereby. The outer or non-facing channel sections of H-beams 50 and 51 are filled with blocks of polystyrene foam 60 and 61, respectively, which are retained in place by means of steel angles 66 and plates 67. The styrofoam block outs inserted between the flanges of the beams at both ends eliminates the need of pipe joints and other time consuming and expensive construction procedures and most importantly, permits the easy cleaning out of the joint and assures a structurally sound, clean, water-tight joint. While I have used the term "H-beams", they could be I-beams or flanged channels as shown in FIG. 3. As illustrated in FIGS. 1 and 2, these polystyrene foam blocks permit the clamshell excavators CE to be guided by the flanges 52, 53 and 54, 55 of the previously cast elongated primary wall sections 10 and 11 of FIG. 2, for example. Thus, in this respect, the invention secures the advantages of the use of a clamshell excavator as is illustrated in the above-mentioned Brunner British patent, the use of H-beam type primary panel (or soldier) constructions, and the bentonite slurry excavation method without any of the significant disadvantages thereof. Thus, there is no need to cast a cementitious fill in and around the soldier H-beams to maintain them in place and then remove the cementitious fill from between the flanges of the H-beam. Moreover, it provides the positive watertight joint that the H-beam type construction provides.

The steel reinforcing structure shown in FIG. 3 is constituted by relatively lightweight vertical bars 70, horizontal bars 71, intermediate weight horizontal bars 72, end horizontal spacer bars 74 and 75. It will be appreciated that the vertical bars 70 and horizontal bars 71 and 72 at each side form a generally rectangular grid of reinforcements and to constitute the cage, and connecting U-shaped elements 74 and 75 are tied to horizontal elements 71 and 72 to the vertical elements 70. This forms an open structure to permit lowering of the tremie pipe 22 to the bottom of the excavation. Furthermore, a lattice system of bars L and angles A is used to rigidly connect the two beams through welding at the ends.

The connected H-beam pair shown in FIG. 1 is being raised and lowered into excavation 26 and has a heavier connecting lattice work and may be provided at the lower edge thereof with earth cutting edges, as mentioned earlier.

After the reaming operation has been completed, any earth or other debris which has been produced at the bottom of the trench is removed by the clamshell excavator CE prior to introducing the connected H-beam pair which will form a permanent part of the installation. As indicated earlier, the reaming tool per se will be used in each individual excavation and will be utilized as the permanent part of the installation in the last wall panel section to be formed.

Referring again to FIGS. 1 and 2, showing the primary panel; the primary panel in this particular construction is excavated with an 11 foot (for example) long clamshell CE which excavates a slot which would permit the installation of a cage having H-beams 10 feet center to center of web and the flanges just touching the extreme limits of the excavation, so this will be the limit of the first excavation. At the conclusion, or once the excavation is carried to sub-grade elevation or bottom of wall elevation, a primary panel cage is installed and that cage consists of two standard rolled wide flange beams tied together with batten plates or lattice work and a mesh of reinforcing steel which in this example are No. 7's ($\frac{7}{8}$ inch diameter) horizontal and No. 5's ($\frac{5}{8}$ inch diameter) vertical. The only reinforcing that is necessary in this wall is the No. 7's or the $\frac{7}{8}$ inch diameter bars which carry the load of the soil to the two beams. This is a concrete beam which spans horizontally from H-beam to H-beam and the reinforcing that is necessary is the No. 7 bar. Any other steel, including the vertical, is only necessary to space the cage in the panel.

The connected beam pair shown in FIG. 3 can be used to reduce the amount of steel in the wall and may be used to position the reinforcement near the unexcavated face of an excavation or, more aptly, the tensile force side of the wall, to thereby reduce the amount of reinforcement steel in a wall.

While the preferred embodiment guide curb GC is positioned along the line of the wall, as described in Brunner's British patent specification No. 913,527, it will be appreciated that other forms of guide curbs may be used, and in other embodiments such guide curb need not be used. A rail line carrying the excavating equipment may be used to define the "line of cut", the wall being located a fixed distance from the rails.

Moreover, instead of conventional steel reinforcing cages, post-tension wall can be constructed in essentially the same manner, the essential difference being that a draped post-tensioning tendon assembly is substituted for the reinforcing steel cages. It will also be appreciated that various forms of bracing, tie-backs, keys, dowels, or sleeves may be installed with the steel reinforcing cage.

What is claimed is:

1. A tool for squaring off and evening out the walls of an elongated trench excavation comprising a parallel pair of spaced steel beams, a plurality connecting steel lattice bars maintaining said beams in spaced parallel relation, and means forming reaming, cutting and smoothing edges on the lower edges of said beams and the lower steel connecting lattices for the walls of said elongated excavation to square off and smooth same and means for lifting and dropping said tool in said elongated trench excavation.

* * * * *

UNITED STATES PATENT OFFICE

CERTIFICATE OF CORRECTION

Patent No. 4,056,154 Dated Nov. 1, 1977

Inventor(s) George John Tamaro

It is certified that error appears in the above-identified patent and that said Letters Patent are hereby corrected as shown below:

Sheet 2 of the drawings should be deleted and substituted with the attached sheet therefor.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*